US006048159A

United States Patent [19]

Nicolas et al.

[11] Patent Number: 6,048,159

[45] Date of Patent: Apr. 11, 2000

[54] AUTOMATIC PICK-UP SYSTEM FOR PROPELLANT CHARGE MODULES STORED IN A MAGAZINE

[75] Inventors: Christophe Nicolas; Dominique Guesnet; Jean Luc Pelissier; Didier Thebault, all of Bourges; Francois Roger, Le Subdray; Christian Gay, La Chapelle St Ursin; Laurent Legrand, Mehun/Yevre, all of France

[73] Assignee: Giat Industries, Versailles, France

[21] Appl. No.: 09/088,080

[22] Filed: Jun. 1, 1998

[51] Int. Cl.[7] ..... B65G 65/02

[52] U.S. Cl. ..... 414/416; 294/104; 414/911

[58] Field of Search ..... 294/104; 414/403, 414/416, 911

[56] References Cited

U.S. PATENT DOCUMENTS

| | | | |
|---|---|---|---|
| 3,982,642 | 9/1976 | Müller | 414/416 |
| 4,083,461 | 4/1978 | Wangermann | 414/416 |
| 4,383,789 | 5/1983 | Takamatsu | 414/911 X |
| 4,708,566 | 11/1987 | Stolzer et al. | 414/911 X |

FOREIGN PATENT DOCUMENTS

| | | | |
|---|---|---|---|
| 0 418 462 A1 | 3/1991 | European Pat. Off. . | |
| 0 616 185 A1 | 9/1994 | European Pat. Off. . | |
| 0 783 094 A1 | 7/1997 | European Pat. Off. . | |
| 2 743 412 | 7/1997 | France . | |
| 136 604 | 7/1979 | Germany | 294/104 |
| 1 315 228 | 6/1987 | U.S.S.R. | 414/416 |

*Primary Examiner*—Janice L. Krizek
*Attorney, Agent, or Firm*—Oliff & Berridge, PLC

[57] ABSTRACT

A system to automatically pick up the propellant charge modules stored in a magazine, such system includes at least one pick-up device carried by a mobile support bracket activated by a driving motor to be able to penetrate inside the magazine and pick up at least one module, wherein the pick-up device has two forks arranged opposite one another and marking out between them a housing to receive at least one module, and at least one retractable retention device intended to protrude inside the housing to retain the module inside the housing after the two forks have moved on either side of the module to be picked up.

9 Claims, 3 Drawing Sheets

AUTOMATIC PICK-UP SYSTEM FOR PROPELLANT CHARGE MODULES STORED IN A MAGAZINE

BACKGROUND OF THE INVENTION

The present invention relates to an automatic pick-up system for propellant charge modules stored in a magazine.

Generally speaking, when a piece of ammunition fired from an artillery cannon is composed by a projectile and a propellant charge introduced successively into the gun chamber, the charge is formed of a combustible envelope of a substantially constant length. This envelope can enclose a number of propellant powder bags which varies according to the amount of powder required to fire the projectile.

Nowadays, there is a tendency to replace this single envelope of a substantially constant length by several modules of substantially the same bulk each containing a predetermined quantity of propellant powder and whose number varies according to the amount of powder required to fire the projectile.

This results in a propellant charge of variable length.

It is known to compartment the internal volume of magazine so as to store several superimposed rows of modules in each compartment, such rows containing n modules axially aligned along the axis of the row, and to use pick-up means carried by a mobile bracket to automatically pick up inside the magazine any or all of the modules of a same row of a compartment and transfer them to a loading system which must then be able to manage a variable number of modules to be taken to the gun chamber in order to fire a projectile.

According to Patent FR-A-2,743,412 the means to pick up a module are formed by a suction cup associated with a venturi effect vacuum generator. The disadvantage of such an automatic pick-up device by partial vacuum lies in that it requires a very reliable safety system to be installed to avoid the risk of leaks which can lead to a module being dropped.

Pick-up means are also known which are formed by pincers having two hinged jaws. This solution, however, requires the manufacture of a magazine whose walls are sufficiently well spaced from one another to allow the pincers to open. This results in an excessively bulky magazine and/or a reduced storage capacity for a given magazine bulk.

SUMMARY OF THE INVENTION

The aim of the invention is notably to overcome the drawbacks of pick-up means incorporating a hinged jaw pincer, whilst providing other advantages.

To this end, the invention proposes a system to automatically pick up the propellant charge modules stored in a magazine, such system comprising at least one pick-up means carried by a mobile support bracket activated by driving means to be able to penetrate inside the magazine and pick up at least one module, such system being characterized in that the pick-up means comprise two forks arranged opposite one another and marking out between them a housing to receive at least one module, and at least one retractable retention means intended to protrude inside the housing to retain the module inside the housing after the two forks have moved on either side of the module to be picked up.

The magazine comprises at least one compartment to store at least one row of modules, such compartment being marked out by two parallel partition walls and spaced at a distance from one another which is slightly greater than the diameter of a module, such partition walls incorporating spacing shims mounted opposite each other to firstly isolate each module of the row, and secondly arrange a space between each module and the two partitions to enable the free passage of the two forks of the pick-up means.

According to one embodiment, the means to retain a module in the housing of the pick-up means is formed by at least one retractable catch which is mounted hinged around one of the two forks of the pick-up means and is permanently stressed by a spring to protrude inside the housing, the module thereby automatically retracting the catch when it enters the housing of the pick-up means.

The system according to the invention also comprises a detection device to detect the presence of a module received in the housing marked out between the two forks of the pick-up means to arrest the downward movement of the support bracket inside the magazine.

According to one embodiment, the detection device of a module is constituted by a pivoting abutment and an electric circuit-breaker which is controlled according to the position of the abutment and connected to means which activate the support bracket of the pick-up means, the finger being pushed over by the module.

The system according to the invention also comprises means to detect the bottom of the magazine to arrest the downward movement of the mobile support bracket inside the magazine when the compartment of the magazine inside which the support bracket is moving no longer contains any modules.

According to one embodiment, the device to detect the bottom of the magazine is constituted by a simple circuit breaker fastened to one of the forks of one of the pick-up means and whose push button protrudes at the free end surface of the fork to directly control the circuit breaker.

Generally speaking, the system comprises several pick-up means evenly spaced along the support bracket to be able to pick up several modules simultaneously. In this case, a module detection device is associated with each pick-up means but with a single circuit breaker which is controlled by any one of the pivoting abutments, whereas only one magazine bottom detection device need be provided.

According to a first advantage of the invention, the pick-up means ensure a reliable hold of the modules without the risk of the accidental dropping of a module.

According to another advantage of the invention, the pick-up means hold the modules in place without exerting any gripping stress, since the modules simply rest on retention means.

According to yet another advantage of the invention, the pick-up means are of minimal bulk only slightly greater than the diameter of a module, which allows the number of on-board modules to be optimized.

BRIEF DESCRIPTION OF THE DRAWING

Other advantages, characteristics and particulars of the invention will become apparent from the explanatory description which follows made in reference to the appended drawings, given merely by way of example and in which.

DETAILED DESCRIPTION OF PREFERRED EMBODIMENTS

Figure 1:
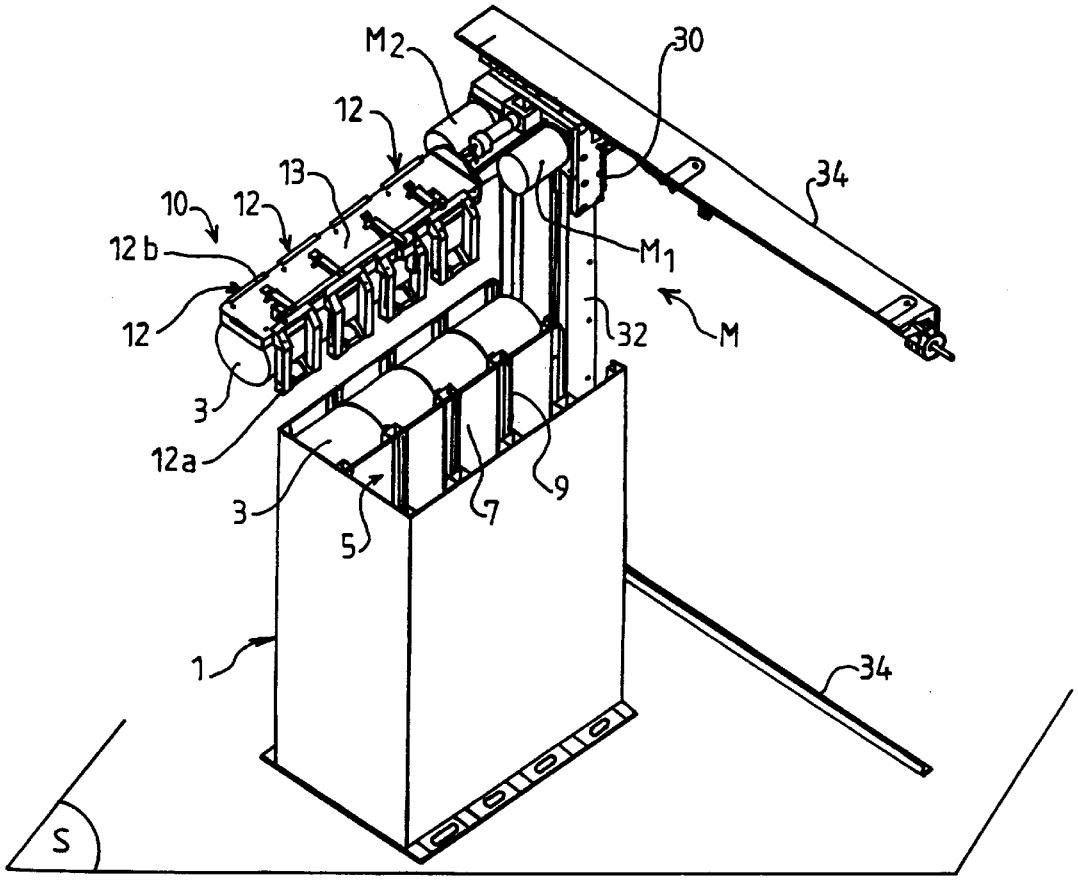
FIG. 1 is a perspective view of a system according to the invention to automatically pick up the propellant charge modules stored in a magazine.

Magazine 1 shown in FIG. 1 enables propellant charge modules 3 to be stored. These modules are substantially of the same diameter, the same length and, in the example shown, a cylindrical shape.

Figure 2:
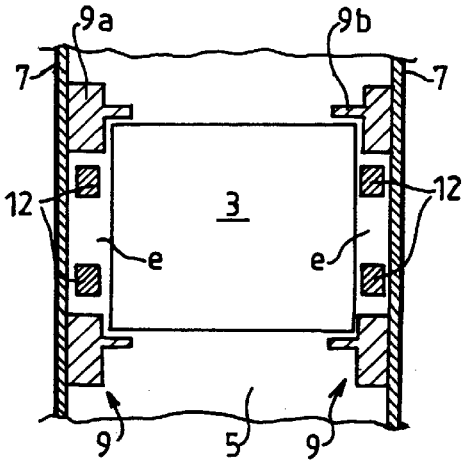
FIG. 2 is a schematic partial top view of the magazine shown in FIG. 1.

Magazine 1 forms a globally rectangular parallelepipedic block whose inner volume is divided into several compartments 5 by parallel and evenly spaced out partitions 7. Each compartment 5 extends substantially over the full height of magazine 1 and enables the storage of n rows of superimposed modules 3 which are axially aligned in each row. Partitions 7 (FIG. 2) support spacing shims 9 mounted opposite each other inside each compartment 5 to isolate each module 3 inside a row and to arrange a space e between each module 3 and the two partitions 7 of each compartment 5. Each spacing shim 9 is formed by a vertical rail with T-shaped cross section and which extends over the full height of magazine 1. The rail incorporates a base 9*a* whose thickness defines the width of each space e and a vertical rib 9*b* which protrudes in compartment 5 to separate two adjacent modules 3 from a same row.

A system 10 enables at least one module 3 to be automatically picked up from one of compartments 5 of magazine 1. System 10 thus comprises at least one means 12 to pick up a module 3 which is carried by a mobile support bracket 13 able to penetrate inside each compartment 5 and pick up a module 3.

Figure 3:
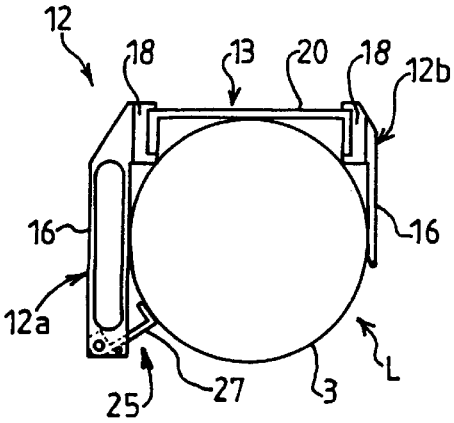
FIG. 3 is a schematic end view of means to pick up a module inside the magazine.
Figure 4:
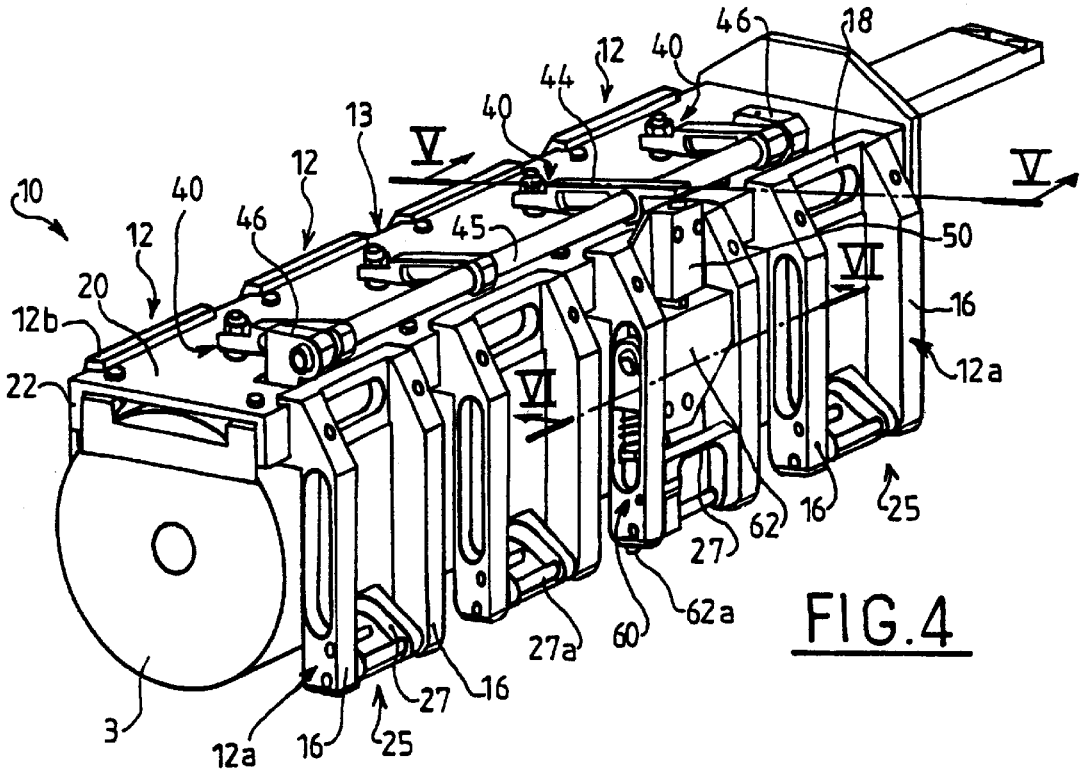
FIG. 4 is a perspective view to illustrate several module pick-up means carried by a mobile support bracket.

With reference to FIGS. 3 and 4, each pick-up means 12 comprise two guiding forks 12*a* and 12*b* which each have two arms 16 brought together at one end by a base 18. The two arms 16 of a fork are separated from one another by a distance which is less then the length of a module 3, and are dimensioned so as to be able to freely engage in space e marked out by spacing shims 9. The two forks 12*a* and 12*b* are mounted on either side of support bracket 13 and are fastened to it by bases 18, so that the two forks 12*a* and 12*b* are opposite each other, extend on the same side of support bracket 13 and are separated from one another by a distance which is slightly greater than the diameter of a module 3.

The two arms of fork 12*a* extend for a length greater than the diameter of a module 3, whereas those of fork 12*b* only extend for a length barely greater than the radius of module 3. Support bracket 13 is, for example, formed by a rigid plate 20 with two longitudinal rims 22 onto which bases 18 of forks 12*a* and 12*b* are fastened.

A housing L (FIG. 3) is thus globally marked out between the two forks 12*a* and 12*b* to receive a module 3, and pick up means 12 also comprise retractable retention means 25 which can protrude inside housing L to hold module 3 in place.

According to the embodiment shown in FIG. 4, retention means 25 are formed by a retractable catch 27 supported by fork 12*a* of pick-up means 12. Catch 27 is, for example, U-shaped and its free ends are connected by a rod 27*a* supported in rotation at the end of the two arms 16 of fork 12*a*. A torsion spring (not shown) forces catch 27 to protrude inside housing L.

In the embodiment shown in FIGS. 1 and 4, system 10 is designed to be able to pick up a whole row of modules 3 from a compartment 5. In other words, support bracket 13 carries as many pick-up means 12 as modules 3 stored in a row of compartment 5. Pick-up means 12 are, in this case, regularly placed along this support bracket 13. Spacing shims 28 (FIG. 6) are fastened onto support bracket 13 between pick-up means 12 to axially immobilize modules 3 and separate two adjacent modules 3 from one another.

Magazine 1 which rests on bearing surface S is open at its upper end as well as on one of its sides which corresponds, for example, to a lateral face of the magazine which extends perpendicularly to the rows of module 3.

The displacements of support bracket 13 are ensured by drive means M located outside magazine 1 and which comprise a device forming a lift 30 able to move in a vertical direction to move support bracket 13 inside compartment 5, one end of bracket 13 being fastened to lift 30. Lift 30 is housed in a cage 32 able to translate along the open side of magazine 1 so as to select a compartment 5. Lift 30 is driven by a first pinion-rack drive device, for example, activated by a first electric motor M1. Cage 32 is driven by a second pinion-rack drive device, for example, activated by a second electric motor M2 to move along the two upper and lower guide rails 34.

A detection device 40 is associated with each pick-up means 12 to detect the presence of a module 3 in housing L marked out between the two forks 12*a* and 12*b* to arrest the downward movement of lift 30 inside a compartment 5 as soon as a module 3 has been received in any one of housings L.

Figure 5:
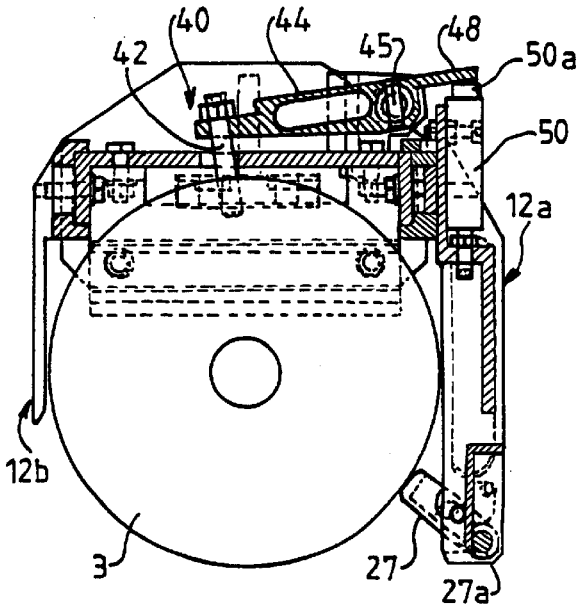
FIG. 5 is a section view along line V—V in FIG. 4.

According to one embodiment shown in FIGS. 4 and 5, each detection device 40 comprises a pivoting abutment 42 which protrudes inside housing L. Each abutment 42 freely passes through plate 20 of support bracket 13, and all the abutments 42 are connected by a linking element 44 to a rod 45 supported in rotation by two bearings 46 carried by plate 20. Rod 45 extends in parallel to support bracket 13 and supports a lug 48, integral with one of the linking elements 44, which is used to drive push button 50*a* of a first circuit breaker 50 which is connected to the control device of motor Ml of lift 30.

Circuit breaker 50, which is thus common to all the pick-up means 12, is mounted between the two arms 16 of fork 12*a* of one of the pick-up means 12.

A device 60 is also provided to detect the bottom of magazine 1 to arrest the downward movement of lift 30 inside a compartment 5 no longer containing any modules 3.

Figure 6:
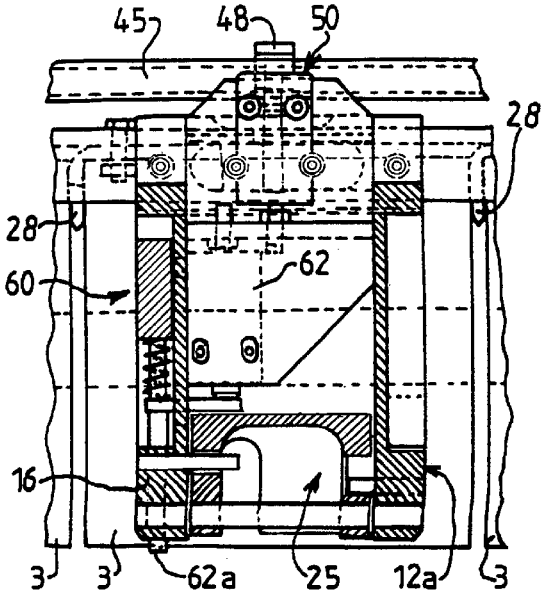
FIG. 6 is a partial section view along line VI—VI in FIG. 4.

According to the embodiment shown in FIGS. 4 and 6, detection device 60 can quite simply be formed by push button 62*a* used to control a second circuit breaker 62 which is mounted on fork 12*a* of pick-up means 12 and also connected to the control device of motor M1 of lift 30. Circuit breaker 62 is, for example, housed inside a recessed arm 16 of one of forks 12*a* of the pick-up means 12, so that push button 62*a* protrudes from the free end face of recessed arm 16.

The operation of system 10 to pick up modules 3 from inside compartment 5 of magazine 1 will now be described.

As lift 30 is meant to be located in the upper part of cage 32, that is to say that support bracket 13 of pick-up means 12 is located outside magazine 1. Motor M2 is activated to move lift cage 32 along guiding rails 34, so as to position support bracket 13 above magazine 1 and opposite one of compartments 5. Motor M2 is switched off so as to immobilize cage 32 in this position, and motor M1 is in turn activated to bring down the lift and, consequently, support bracket 13 inside selected compartment 5.

Forks 12*a* and 12*b* of pick-up means 12 penetrate inside compartment 5 and freely pass through spaces e marked out by spacing shims 9. As soon as a catch 27 of a pick-up means comes into contact with a module 3 stored in compartment 5, module 3 automatically makes catch 27 retract by penetrating inside housing L marked out by the two forks 12*a* and 12*b* of pick-up means 12.

When module 3 comes into contact with pivoting abutment 42 of detection device 40, module 3 pushes abutment 42 over, thereby causing rod 45 to rotate which, by means of lug 48, acts on push button 50*a* of circuit breaker 50. The activation of circuit breaker 50 causes the downward movement of lift 30 to be arrested so as to immobilize support bracket 13. Module 3 is thus fully engaged in housing L marked out between the two forks 12*a* and 12*b* of pick-up means 12, and module 3 is retained in this housing L by resting on catch 27 which has once again taken up its protruding position inside housing L.

The rotational direction of motor M1 is then inverted so as to raise lift 30 and extract support bracket 13 from the magazine. Motor M2 is then activated to move cage 32 towards a transfer device (not shown) which will take charge of modules 3 removed from magazine 1 and transfer them to the gun chamber.

When support bracket 13 penetrates in a compartment 5 no longer containing any modules, the downward movement of lift 30 will be automatically suspended as soon as push button 62*a*, which drives circuit breaker 60, comes into contact with the bottom of the magazine.

Some pick-up system devices 10 can be made according to embodiments other than those described previously.

In particular, instead of providing a detection device 40 for a module 3 for each pick-up means, a single detection device common to all the pick-up means 12 can be provided. This purely electronic detection device can be based on the use of a photoemitter and a photoreceptor respectively mounted at the ends of support bracket 13. The advantage of such a detection device is in that the pivoting abutments 42 could be eliminated. Each pick-up module 12 can also be equipped with a circuit breaker which directly detects the presence of a module. The advantage of such a device is in that all the pivoting abutments, linking elements 44 and rod 45 could be eliminated.

Figure 7:
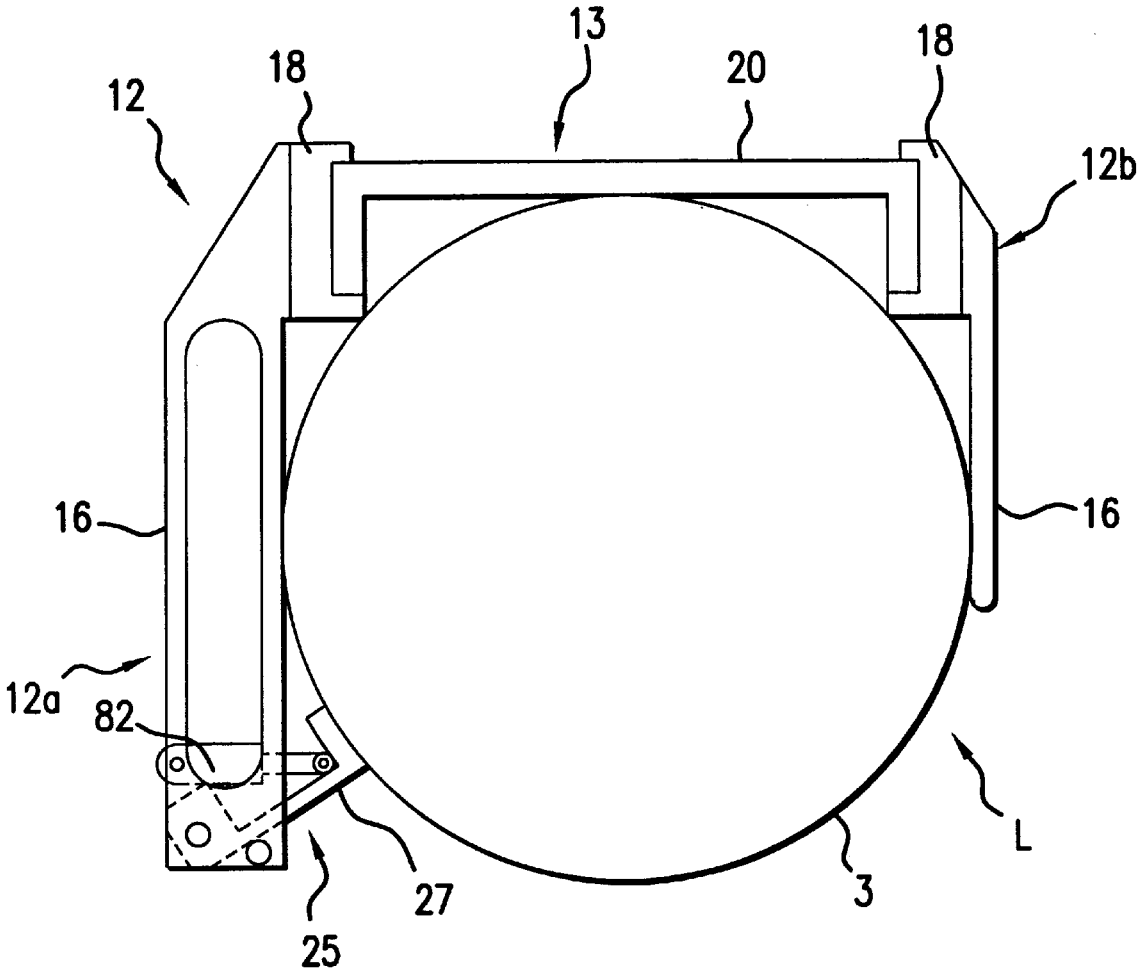
FIG. 7 is an enlarged view of FIG. 3 showing an actuator.

Similarly, each retention means 25 for a module 3 could be driven by an electric or pneumatic actuator 82 (FIG. 7), which would possibly allow all or part of the n modules of a same row of the compartment to be picked up.

Lastly, the invention is not limited to cylindrically-shaped modules.

We claim:

1. A system to automatically pick up propellant charge modules stored in a magazine, such system comprising:

at least one pick-up means carried by a mobile support bracket activated by driving means to be able to penetrate inside said magazine and pick up at least one module, wherein said pick-up means comprises two forks arranged opposite one another and marking out between them a housing to receive at least one module, and at least one retractable retention means intended to protrude inside said housing to retain said module inside said housing after said two forks have been moved into a position on either side of said module to be picked up, said means to retain said one module in said housing of said pick-up means is formed by at least one retractable catch mounted hinged around one of said two forks of said pick-up means, and said catch is permanently stressed to protrude inside said housing, said module automatically retracting said catch when it enters the housing.

2. A system according to claim 1, wherein said magazine comprises at least one compartment to store at least one row of modules, and wherein said compartment is marked out by two partition walls incorporating spacing shims mounted opposite each other to firstly isolate each said module of said row, and secondly arrange a space between each said module and said two partition walls to enable the free passage of said two forks of said pick-up means.

3. A system according to claim 2, wherein said retention means is formed of a retractable catch driven by an electric or pneumatic actuator.

4. A system according to claim 1, further comprising a detection device to detect the bottom of said magazine to act on said drive means and arrest the downward movement of said support bracket when said magazine no longer contains any modules.

5. A system according to claim 4, said device to detect the bottom of said magazine is constituted by a simple circuit breaker fastened to one of said forks of one of said pick-up means and controlled by a push button protruding at the free end surface of said one of said forks.

6. A system according to claim 1, further comprising a detection device to detect the presence of said module inside said housing marked out between said two forks of said pick-up means to act on said drive means and arrest the downward movement of said support bracket inside said magazine.

7. A system according to claim 6, wherein said detection device is constituted by a pivoting abutment and an electric circuit-breaker whose push button is controlled by the position of said pivoting abutment.

8. A system according to claim 7, wherein said detection device is carried on said support bracket, and in that said pivoting abutment protrudes inside the housing and is controlled by said module once it has been received in the housing.

9. A system according to claim 6, wherein said detection device is an electronic device comprising a photoemitter and a photoreceptor mounted on the two ends of said support bracket.

* * * * *